United States Patent [19]

Wildgoose

[11] 4,311,234

[45] Jan. 19, 1982

[54] DISPLAY AND DISPENSING CONTAINERS

[75] Inventor: Charles R. Wildgoose, Richmond, England

[73] Assignee: The Gillette Company, Boston, Mass.

[21] Appl. No.: 124,883

[22] Filed: Feb. 26, 1980

[30] Foreign Application Priority Data

Feb. 27, 1979 [GB] United Kingdom ..... 6924/79

[51] Int. Cl.[3] ..... A45C 11/26

[52] U.S. Cl. ..... 206/354; 206/469

[58] Field of Search ..... 206/352, 354, 355, 356, 206/357, 469, 461, 467

[56] References Cited

U.S. PATENT DOCUMENTS

| | | | |
|---|---|---|---|
| 2,408,222 | 9/1946 | Muros | 206/354 |
| 3,346,108 | 10/1967 | Nizelman | 206/469 |
| 3,685,648 | 8/1972 | Heller | 206/469 |
| 3,921,802 | 11/1975 | Thompson | 206/390 |

FOREIGN PATENT DOCUMENTS

| | | | |
|---|---|---|---|
| 1326532 | 4/1963 | France | 206/469 |
| 951214 | 3/1964 | United Kingdom | 206/469 |

*Primary Examiner*—Joseph Man-Fu Moy
*Attorney, Agent, or Firm*—Mandel E. Slater

[57] ABSTRACT

A display and dispensing container for wrapped razor blades includes a rectangular blister of transparent material attached to a backing card having a removable portion which is torn out to create a finger hole, in order to permit the blades to be dispensed singly through an exit slot formed between a lip of the blister and an adjacent edge of the card.

5 Claims, 6 Drawing Figures

DISPLAY AND DISPENSING CONTAINERS

BACKGROUND OF THE INVENTION

1. Field of the Invention

This invention relates to display and dispensing containers for wrapped razor blades, such as wafer-thin, double-edged razor blades wrapped in a paper envelope.

2. Description of the Prior Art

Containers of this type have been marketed for many years and typically consist of a molded plastics container defining a storage compartment in which a stack of wrapped blades is housed. The compartment is closed at three edges and has a dispensing opening in the form of a slit at the fourth edge. The bottom wall of the compartment is usually solid and the top wall has a finger opening, through which the user can insert a thumb or finger to engage the uppermost blade of the stack of blades, and to push that blade out through the dispensing opening.

A widely marketed dispenser of this general form is described and illustrated in British Patent Specification No. 878330.

The known dispensers are prefectly satisfactory in carrying out this function and the object of the present invention is to provide a container of the same general form but which is cheaper to produce.

SUMMARY OF THE INVENTION

In accordance with a feature of the invention, this object is achieved by the provision of a display and dispensing container for wrapped razor blades, consisting of a backing card and a blister of transparent material secured at its periphery to the card to define therewith a storage compartment in which a stack of wrapped blades is housed. The card has a portion delineated by a line of weakness to permit ready detachment of the portion from the remainder of the card to form a finger opening through the card, an exit slot being formed between adjacent edges of the card and the blister at one end of the compartment for the dispensing of individual wrapped blades from the compartment.

With this construction, the container can be produced at substantially reduced cost, relative to known containers of molded plastics construction.

BRIEF DESCRIPTION OF THE DRAWING

One form of container in accordance with the invention is described below, by way of example, with reference to the accompanying drawing, in which.

DESCRIPTION OF A PREFERRED EMBODIMENT

Figure 1:
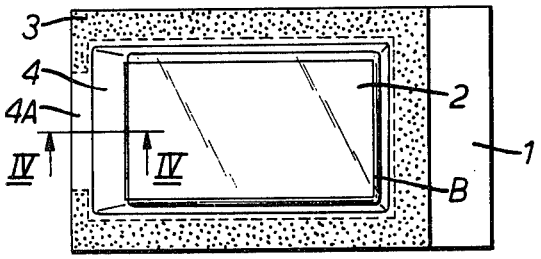
FIG. 1 is a front view of the container.
Figure 2:
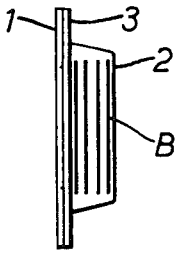
FIG. 2 is an end view.

The container shown in FIGS. 1 to 5 includes a rectangular backing card 1 and a transparent blister 2 having a peripheral flange 3 adhesively secured to the card along its longer edges and at one end edge, over the area indicated by stippling in FIG. 1. At its fourth edge the blister has a sloping end wall 4 having at its lower end edge a lip 4A which is closely adjacent the edge of the card, but is free of the card except over its end portions which are adhesively secured to the card like the flange 3.

The blister is shaped to define, with the card, a storage compartment in which there is housed a stack of wrapped, double-edged razor blades B.

The card is formed with a line of weakness 5, by partial severing of the card, to define a readily detachable portion 6. The portion 6 is subdivided by a transverse line of weakness 7 to define a sub-portion 8.

Figure 3:
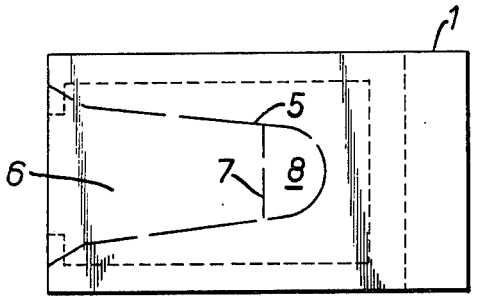
FIG. 3 is a rear view.

As seen in FIG. 3, the portion 6 extends from a medial region of card to the end edge adjacent the free edge of the blister, and the line of weakness 5 traverses the regions of adhesive contact between the lip 4A and the card.

Figure 4:
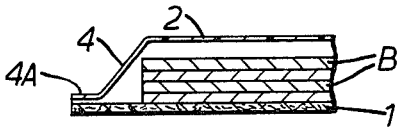
FIG. 4 is a scrap section on the line IV—IV of FIG. 1, drawn to a larger scale.
Figure 5:
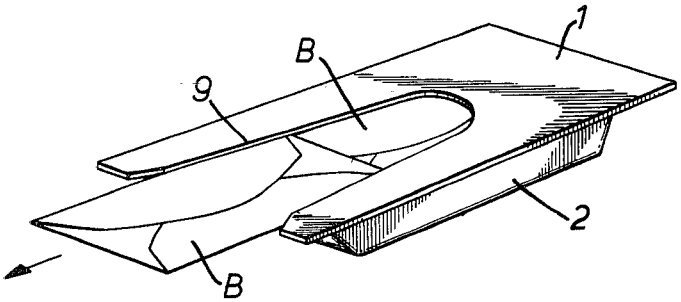
FIG. 5 is a rear perspective view illustrating the dispensing of a wrapped blade.

The container is opened by the user pressing in the subportion 8 to break it free of the main portion of the card, and then pulling away the region 6, detaching it completely from the card, thus forming a finger opening 9 as seen in FIG. 5. A thumb or finger is then inserted through the opening to engage the adjacent blade B and push it endways through the dispensing slit existing between the adjacent free edges of the card and blister. As indicated in FIG. 4, the lip 4A of the blister is contiguous with the card, but the card and blister are sufficiently flexible to permit their slight separation when the blade is forced between them. Prior to the removal of the region 6, accidental dispensing of blades, e.g. during transit, is prevented by the adhesion between the card and the end portions of lip 4A, this adhesion being broken when the region 6 is removed.

Figure 6:
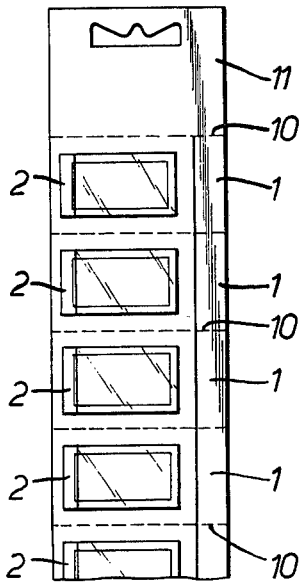
FIG. 6 is a front view of a number of the containers incorporated in a composite display card.

Apart from its simplicity and low cost, the container has the advantage that it can be provided singly or as part of a composite array, as illustrated in FIG. 6, which shows a composite display card in which adjacent containers, each of the form described above, are arranged side-by-side on an integral card, the individual containers being separated from each other by lines of perforations 10 permitting ready detachment of individual containers as desired. The upper portion of the card is preferably formed as a hanger tab 11.

I claim:

1. A display and dispensing container for wrapped razor blades, consisting of a backing card and blister of transparent material secured at its periphery to the card to define therewith a storage compartment in which a stack of wrapped blades is housed; wherein said card has a portion delineated by a line of weakness to permit ready detachment of the portion from the remainder of the card to form a finger opening through the card; wherein said blister is of rectangular form and has outwardly extending flanges secured along their lengths to the card at the two long edges of the blister and at one end edge, the opposite end edge being adjacent an edge of said card, but free of said card along at least a major portion of the length of said end edge, to form an exit slot at one end of the compartment for the dispensing of individual wrapped blades from the compartment; and wherein said exit slot has an initial length less than the width of the wrapped blades, said slot being increased in length by removal of said portion, whereby to permit dispensing of the wrapped blades ony after removal of said portion.

2. A container according to claim 1, wherein said portion extends from one end edge of said card, adjacent said exit slot, towards a medial region of said card.

3. A container according to claim 2, wherein said portion includes a sub-portion positioned at said medial region which is connected to the remainder of said portion and said card by lines of weakness which permit said sub-portion to be broken away by digital pressure.

4. A container according to claim 1, wherein said blister has an end wall adjacent said slot which slopes downwardly towards said slot so as to form a ramp which leads wrapped blades towards said slot as they are dispensed.

5. A container according to claim 1, in combination with a plurality of other containers of the same form, in which the cards are integral with each other and interconnected by lines of weakness which permit the individual containers to be readily separated from each other.

* * * * *